United States Patent [19]

Minami et al.

[11] 4,326,721

[45] Apr. 27, 1982

[54] TOY HAVING ATTACK OBJECT LOCATED ON ARCUATE MOVING FRAMEWORK

[75] Inventors: Koichi Minami; Hiroyuki Watanabe, both of Tokyo, Japan

[73] Assignee: Tomy Kogyo Co., Inc., Tokyo, Japan

[21] Appl. No.: 202,743

[22] Filed: Oct. 31, 1980

[30] Foreign Application Priority Data

Oct. 13, 1980 [JP] Japan ..... 55-145411[U]

[51] Int. Cl.[3] ..... A63F 9/00

[52] U.S. Cl. ..... 273/315; 273/1 GE

[58] Field of Search ..... 273/315, 316, 1 GC, 273/1 GE

[56] References Cited

U.S. PATENT DOCUMENTS

| | | | |
|---|---|---|---|
| 2,300,132 | 10/1942 | New | 273/316 |
| 3,171,215 | 3/1965 | Glass et al. | 273/1 GC |
| 3,819,178 | 6/1974 | Ochi | 273/1 GC |
| 3,843,128 | 10/1974 | Licitis et al. | 273/315 |
| 4,006,899 | 2/1977 | Lohr et al. | 273/85 R |
| 4,231,571 | 11/1980 | Watanabe | 273/1 GA |
| 4,241,925 | 12/1980 | Watanabe | 273/316 |

FOREIGN PATENT DOCUMENTS

| | | | |
|---|---|---|---|
| 703604 | 4/1966 | Italy | 273/1 GE |
| 900104 | 7/1962 | United Kingdom | 273/316 |

*Primary Examiner*—Anton O. Oechsle

*Attorney, Agent, or Firm*—K. H. Boswell; Edward D. O'Brian

[57] ABSTRACT

A toy game includes a housing having a plurality of target members positioned in a side by side manner near one end of the housing. An attack object can move from a central position in the housing toward the target members and if correctly positioned it can interact with the target members. The attack member is capable of two modes of movement, however, it can only move in one mode at a time. One of the modes of movement is a transverse movement essentially across the width of the target members. The other mode of movement is from a starting point near the central portion of the housing toward one of the objects. If the two movements are coordinated the attack object is capable of interacting with one of the targets. A drive motor moves the attack object in each of the modes of movement via a motion diverting mechanism which is capable of converting motion of the motor into one or the other of the modes of movement at any specific instance of time.

11 Claims, 7 Drawing Figures

10
28
16
22
32
34
20
18c
18b
18a
18
26
24
14
12

188
178c
22
162b
170c
18
166c
162
18c
170b
18b
166b
18a
170a
166a
178a
178b
178
180
186c
186b
186a
32

148
164
5
18a
18b
18c
18
32
162a
22
30
162
144
20
34
194
150
152
154
124
128
126
138
146
140
142
130
132
136
134
122
102
36
120
160
158
86
58
42
106
98
156
40
38
88
96
90
54
52
92
94
48
66
56
104
62
44
64
46
68
70
72
78
76
80
82
74
50
24
84
OFF

TOY HAVING ATTACK OBJECT LOCATED ON ARCUATE MOVING FRAMEWORK

BACKGROUND OF THE INVENTION

This invention is related to a toy game of the type which has at least one target and an attack member capable of moving so as to attack the target. The movement of the attack member is in one of two movement modes, a first mode of movement wherein a frame member on which the attack object moves oscillates back and forth with respect to the target and a second mode of movement wherein the attack member moves along the frame member toward the target. The propulsion mechanism for moving the attack member allows one or the other but not simultaneously both modes of movement.

In applications Ser. Nos. 971,646, filed Dec. 21, 1978, now U.S. Pat. No. 4,231,571, and 014,056, filed Feb. 22, 1979, now U.S. Pat. No. 4,241,925, both of which are assigned to the same assignee as this application, certain games are described wherein a series of a first type of objects are carried on endless belts and a second type of object is movable with respect to these belts. Both of these games utilize a different type of movement of the second type of object with respect to the endless belts on which the first type object are located. Both of these games are highly interesting and have found wide acceptance because of their play value. These games, however, could be referred to as table top games in that they are generally sized such that they conveniently can be used on a table but can also be hand carried if moved from one location to another.

Other games related to the type noted in the preceding paragraph are known wherein one member is moved in attempts to either avoid or to attack a second member. These games include U.S. Pat. Nos. 4,006,899; 3,171,215; 3,843,128; 3,819,178 and British Pat. No. 900,104. Typically the games described in these patents are those which can be found in penny arcade type pavilions of amusement parks or the like. These games normally each require their own individual supporting structure as they are normally much larger in nature than the games noted in the preceding paragraph.

As an example of the games described in the immediate paragraph the game described in the U.S. Pat. No. 3,843,128 is typical. In this game a plurality of ships move in a horizontal manner across a distantly appearing horizon. The operator of the game views the ships through a periscope-like apparatus and attempts to "hit" them by launching a light blip simulating a torpedo from his periscope toward the moving ships.

These games have found wide acceptance in the penny arcade type surroundings, however, as noted above, they are very bulky and thus take up considerable space and are expensive.

The principle on which all of the above games rely seems to be generally accepted by the public because it requires certain player skills to manipulate the mechanical and/or electrical components of the game. All of the above mentioned games, however, can be considered to be too bulky for transporting on an individual's person and thus really cannot be considered portable. As a consequence of their size and their complexity they also are sufficiently expensive that their purchase by certain consumer groups is precluded.

BRIEF SUMMARY OF THE INVENTION

In view of the above discussion it is a broad object of this invention to provide a game which employs the principles of the type of games wherein a first object moves towards and attacks a second object. This broad object, however, is tempered by a subordinate object to provide a game of the type noted which is capable of being carried in pocket or purse. This requires that the game be sufficiently small in nature that it can be so carried. It is an additional object, however, even though the game is physically small to provide a game that is complex enough to achieve the same play value as the larger more expensive penny arcade type games.

These and other objects as will be evident from the remainder of this specification will be achieved by providing a toy game which comprises: a housing; at least one target member positioned within a target field on said housing; an attack means movably located on said housing and capable of moving at any particular instance of time in one or the other, but not both of two modes of movement with respect to the target field, one of the modes of movement sweeping in a reciprocal manner across the width of the target field, the other mode of movement moving at least a portion of the attack means in a direction of movement essentially normal to the direction of the first mode of movement, together with two modes of movement capable of positioning at least a portion of the attack means in an interacting position with said target member allowing said portion of said attack means to interact with said target member; a drive means located on said housing; a drive diverter means operatively associated with both said drive means and said attack means, said drive diverter means capable of propagating motion from said drive means to said attack means to move said attack means in one or the other, but not simultaneously in both modes of movement.

In the preferred embodiment of the toy the attack means includes an elongated frame which is pivotally attached to the housing near one of its ends such that the other end is capable of moving in an arcuate manner. A carrier means having an attack object located on it is movably mounted on the frame in a manner allowing the attack object to move from one end of the frame to the other. The first mode of movement constitutes arcuate movement of the frame and the second mode of movement constitutes movement of the the attack object between the two ends of the frame.

In the preferred embodiment the carrier means constitutes an endless belt mounted for endless movement on the frame. The attack object is located on the surface of the belt and thus continuously rotates with the belt upon the frame. Preferredly a plurality of target members will be used and the attack object will be capable of interacting individually with each of these.

The endless belt and the frame are caused to move by a motor means located on the housing which interacts through a gear means to cause the appropriate movement. The gear means includes at least a first and second gear train. One of these transferring movement of the motor to reciprocally move the frame and the second transferring movement of the motor to rotate the endless belt. A shifting means is utilized to engage first one or the other of the gear trains, but not both at the same time.

BRIEF DESCRIPTION OF THE DRAWINGS

This invention will be better understood when taken in conjunction with the drawings wherein.

The invention disclosed in the specification utilizes certain principles and/or concepts as are set forth and claimed in the claims appended hereto. Those skilled in the arts to which this invention pertains will realize that these principles and/or concepts are capable of being expressed in a variety of forms and/or embodiments. For these reasons this invention is not to be construed as being limited to the exact embodiments herein described but should be considered in light of the claims.

DETAILED DESCRIPTION

Figures 1, 4:
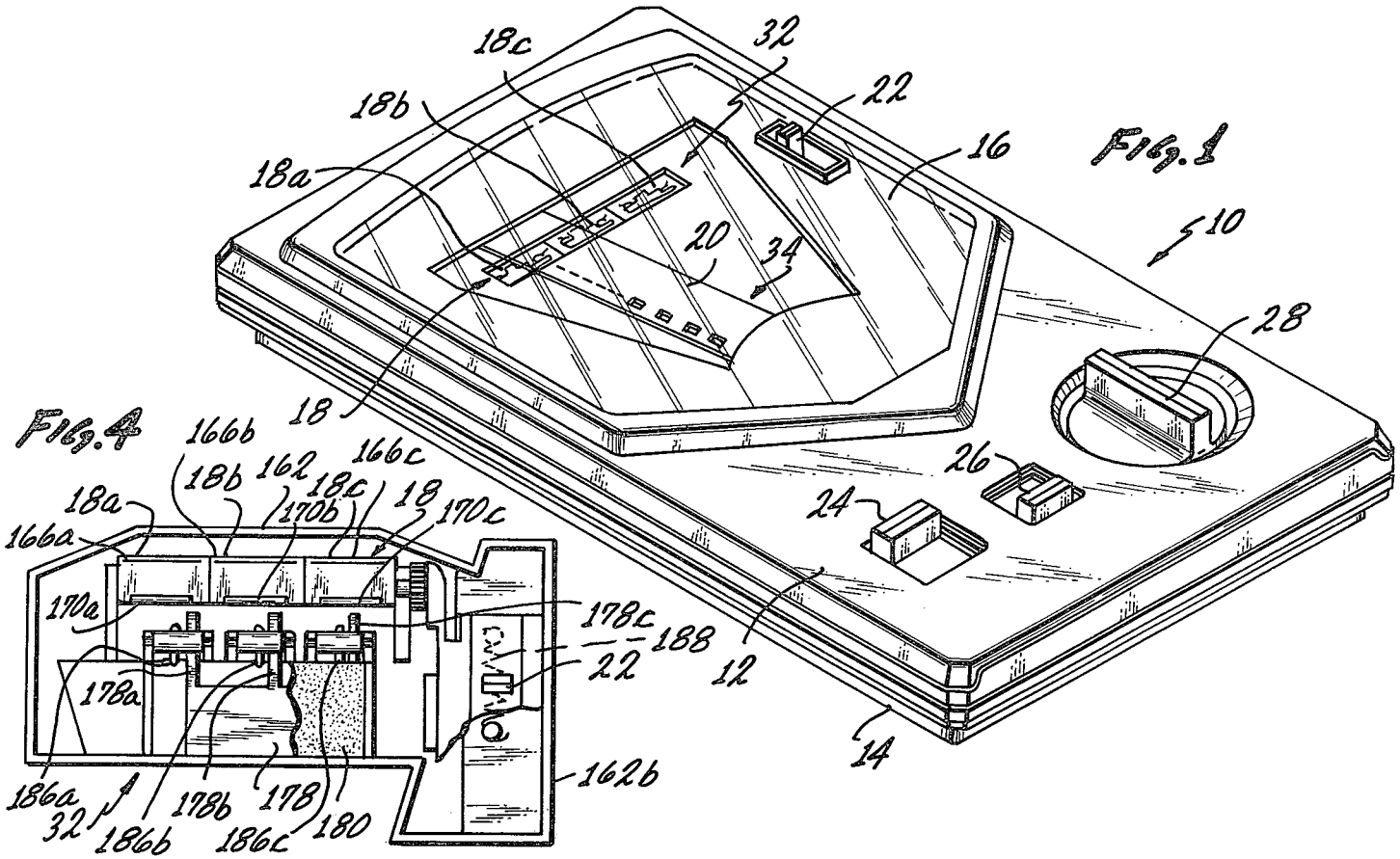
FIG. 1 is an isometric view of the outside of the housing of the toy game of the invention.
FIG. 4 is a top plan view partially cut away showing certain components found in the top portion of FIG. 2.

The toy game 10 of the invention is contained within an upper housing 12 and a lower housing 14. These are appropriately joined by screws, not shown or numbered, passing through the bottom surface of the housing 14 into the upper housing 12. The majority of the upper surface of the upper housing 12 contains a viewing window 16 through which a plurality of targets 18*a, b* and *c* are viewable. As seen in FIG. 1 also viewable through the window 16 is a portion of the surface of an endless belt 20.

A series of buttons, hereinafter numbered, project upwardly through the upper housing 12 such that they are manipulatable by the digits of the user of the game. A first button, the target reset button 22, is found generally to the right of the targets 18. The second button, the attack object launch button 24, is on the left hand side of the housing. To the right of the launch button 24 is an off/on button 26, and to the right of it is a wind-up knob 28.

Figures 2, 7:
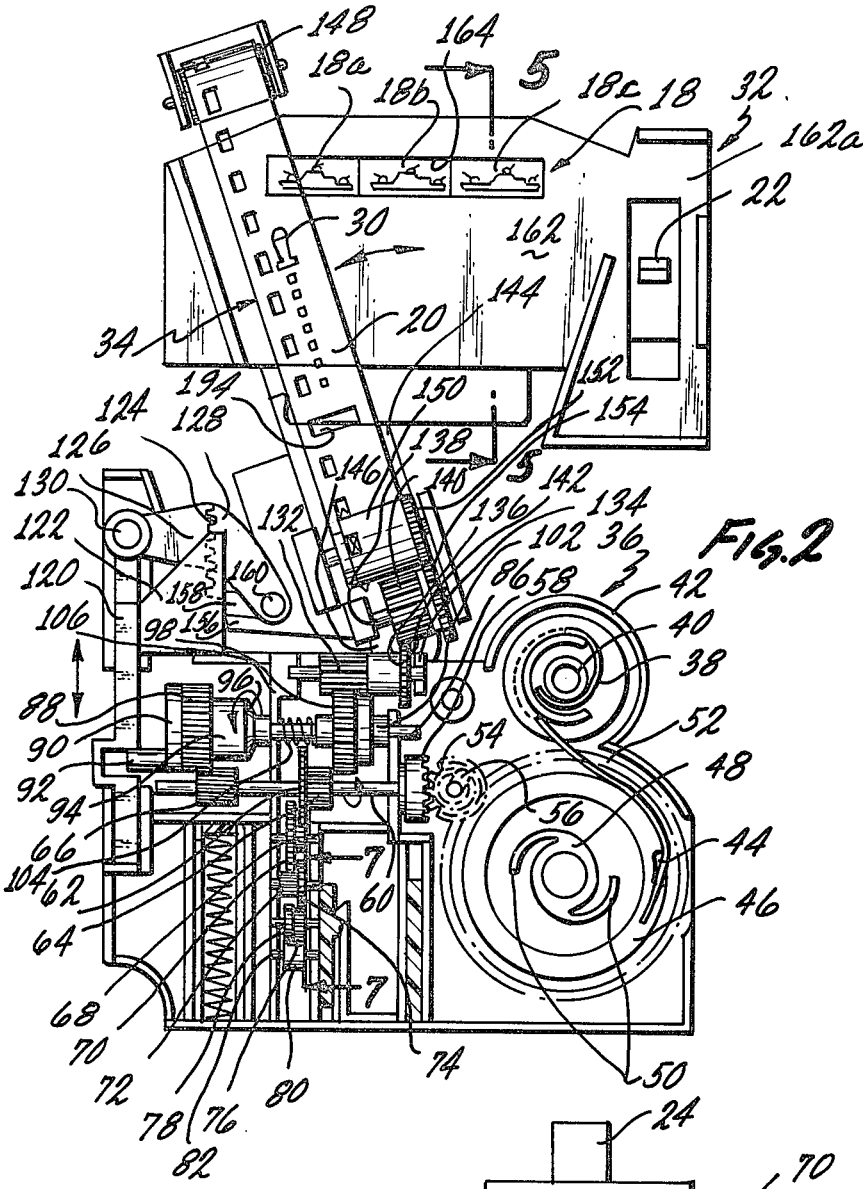
FIG. 2 is a top plan view of certain of the internal structures within the housing of FIG. 1.
FIG. 7 is a side elevational view about the line 7—7 of FIG. 2.

Generally the game works as follows. The game is energized by rotating the wind-up knob 28 clockwise until it stops. The target reset button 22 is depressed downwardly toward the wind-up knob 28 to reset the targets 18*a, b* and *c* if they have not already been reset. At this time the off/on button 26 is pushed to the on position. This causes the endless belt 20 to reciprocate back and forth within the window 16 through the targets 18*a, b* and *c*. As will be evident from the discussion below the endless belt 20 moves in an arcuate manner about a pivot point within the housing which is essentially centralized within the toy game 10. The end of the endless belt 20 nearer the target 18 thus moves in a sweeping manner across the targets. The targets 18*a, b* and *c* thus can be considered as being located within a target field with the endless belt 20 moving back and forth across this target field. When the player of the game believes that the endless belt 20 is positioned such that a target can be hit, the launch button 24 is pushed which immediately ceases the oscillatory motion of the endless belt 20 and starts rotation of the endless belt 20 about certain frame members hereinafter described. An attack object 30 as seen in FIG. 2 on the surface of endless belt 20 then proceeds toward the target field. If the oscillatory motion of the endless belt 20 was stopped at a proper time to align the belt directly beneath the target 18, the attack objct 30 will then strike the target in its center and trip the individual target whether it be target 18*a, b* or *c*.

In playing the game each time the attack object launch button 24 is moved the endless belt will cease its back and forth oscillatory motion and switch to rotational motion of the belt along the frame member hereinafter described. When the button 24 is released, movement of the endless belt about the frame member ceases and the back and forth oscillatory movement begins once again. In order then to trip all three of the targets 18*a, b* and *c* it is necessary to correctly stop the endless belt 20 below each of the targets respectively and to change the motion from the oscillatory one to the movement of the belt on the frame. As will be evident hereinafter, the toy will operate for a finite period of time until a spring (hereinafter identified) which is wound by button 28, runs down.

Looking now to the inside of the toy 10, as seen in FIGS. 2 through FIG. 7, several generalized systems are evident. The first is the target system 32 seen in the upper portion of FIG. 2. The second would be the attack means system 34 which includes the endless belt 20 positioned in conjunction with the target system. The third system is the drive system 36 seen in the lowermost portion of FIG. 2.

The drive system 36 includes a spirally wound spring 38 which is attached at one end to a projection 40 located within a housing 42. The spring 38 is spirally wound within the housing 42 around the projection 40. The other end of the spring 38 attaches into an appropriate notch 44 on rotatable drum 46. Drum 46 is connected via clutch member 48 to the underside of wind-up knob 28. The wind-up knob 28 contains appropriate projections on its underside which interact with two spiral arms 50 such that when the wind-up knob 28 is rotated clockwise, motion is transferred to the drum 46, but when it is rotated counterclockwise the spiral arms 50 flex inwardly and no rotational movement is transferred. To activate the toy, the wind-up knob 28 is turned clockwise to wind the spiral spring 38 off of the projection 40 and around the drum 46. Since the spring 38 is fixedly attached to the projection 40 it will be biased to rewind itself back around the projection 40 imparting a counterclockwise rotation to drum 46 in the process of doing so.

Drum 46 has a set of spur gear teeth 52 around its periphery. These teeth 52 interact with swing gear 54 which is slidably mounted in appropriate slots 56 within the lower housing 14. When drum 46 is rotated clockwise, i.e., the spring 38 is being rotated on it, swing gear 54 moves upwardly within the slot 56 away from engagement with crown gear 58. When the drum 46 rotates counterclockwise under the bias of spring 38 the swing gear 54 moves downwardly in the slots 56 and engages crown gear 58. Counterclockwise rotation of the drum 34 is therefore transferred via swing gear 54 to crown gear 58. The crown gear 58 is attached to axle 60. Also attached to axle 60 is a combination spur gear 62 and pinion 64 near its center and a second pinion 66 on the other end.

A plurality of gears each individually hereinafter identified are generally grouped into three drive trains within the drive system 36.

The first gear train is always coupled with spur gear 62 and is used for controlling the speed of counterclockwise rotation of the drum 46 and therefore the speed of all other movement within the drive system 36. Spur gear 62 engages a pinion 68 which is formed with a spur gear 70 such that they rotate as a unit. Both of these rotate on appropriate axle (not numbered). Spur gear 70 engages pinion 72 which is formed as a unit with spur gear 74. These are also rotated on an appropriate axle (not identified). Spur gear 74 engages a spur gear 76 which is formed as a unit with escapement gear 78. Escapement gear 78 interacts with escapement 80 which is pivotally mounted about axle 82. Speed of rotation of the gears 62 through 78 is governed by interaction of the escapement 80 with escapement gear 78. Because of frictional forces as well as the balance and weight of the escapement 80 it is only capable of of back and forth movement at a limiting speed about its axle 82.

On the bottom of the off/on button 26 is a downwardly projection tab 84 which when the game 10 is in the off mode interacts with and prevents movement of the escapement 80. But in the on mode it slides to the position shown in FIG. 7 wherein it is free and clear of escapement 80 and this does not influence it. This first gear train can thus be seen to govern both the speed of the drive system 36 as well as the off and on function of the toy 10.

Figure 3:
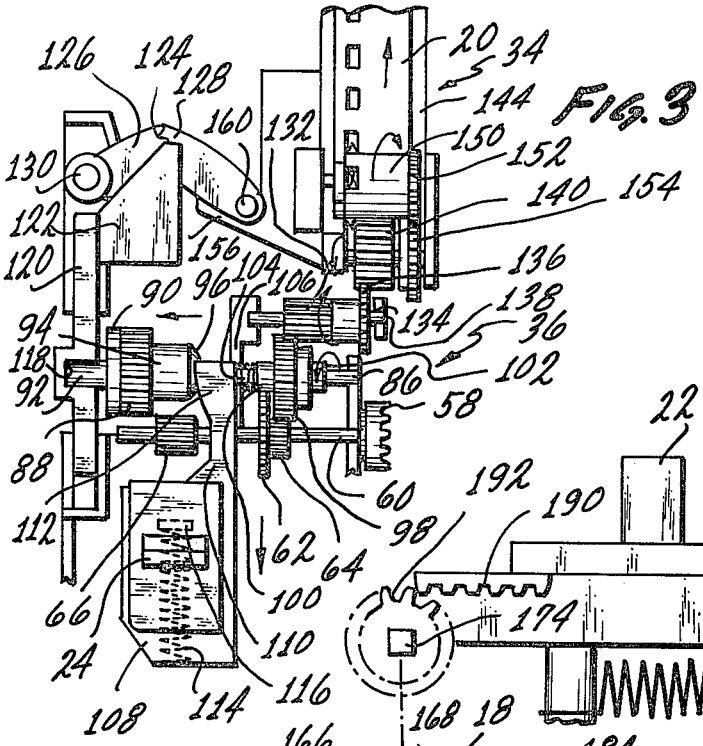
FIG. 3 is a top plan view of a portion of the mechanism shown in FIG. 2, however, showing this mechanism in a different spacial relationship than that shown in FIG. 2.

The second and third drive trains are mutually exclusive. When one of these is engaged the other is not and vice versa. This works as follows. Paralleling axle 60 and immediately above it in FIGS. 2 and 3 is an axle 86 which is free to slide back and forth as viewed in FIGS. 2 and 3 within its bearing mountings (not separately identified or numbered). At the end of axle 86, on the left hand side of FIGS. 2 and 3, is a spur gear 88 having a crank disk and crank pin 90 and 92 respectively fixedly attached to it. On the other side of spur gear 88 is a bushing 94 having a shoulder 96 located thereon. The spur gear 88, the crank disk 90 and the bushing 94 are all fixedly attached to the axle 86 and rotate with it. A second spur gear 98 is also mounted on axle 86 but is free to rotate thereon. The spur gear 98 is fixedly positioned against axial movement on axle 86 by bushings 100 and 102.

A compression spring 104 is located about axle 86 between bushing 100 and a housing wall 106 which serves as one of the bearing surfaces of axle 86. Axle 86 is free to slide back and forth between the positions shown in FIGS. 2 and 3, however it is biased toward the position shown in FIG. 2 by the spring 104. In the position shown in FIG. 2 spur gear 88 mates with and is rotated by pinion 66 while spur gear 98 is not engaged with pinion 64. In the position shown in FIG. 3 spur gear 98 is engaged with pinion 64 but spur gear 88 has slid free of pinion 66. Therefore in the position shown in FIG. 2 rotation of axle 60 is transferred to spur gear 88 and in the position shown in FIG. 3 rotation of axle 60 is transferred to spur gear 98.

The position of axle 86 therefore determines which of the spur gears 88 or 98 are ultimately rotated by the gears on axle 60. The position of axle 86 is changed by shifting member 108 which is directly linked to the bottom of attack object launch button 54. The shifting member 108 has a waist area 110 with a wedge area 112 next to it. The shifting member 108 is positioned against the shoulder 96 of the bushing 94. If the waist area is positioned next to the shoulder 96 (this is not depicted in the figures), then the axle 86 is shifted to the right under the influence of spring 104 as per FIG. 2. If the wedge area 112 is positioned against the shoulder 96 then the axle 86 is forced to the left as per FIG. 3. Normally, the shifting member 108 will be positioned such that the gear trains are engaged as per FIG. 2. This is accomplished by incorporating a compression spring 114 underneath the launch button 24 such that it interacts with a projection 116 projecting downward from the underneath surface of launch button 24 such that the launch button 24 and the shifting member 108 are biased in an upward direction as viewed in FIGS. 2 and 3.

The crank pin 92 fits into an appropriate slot 118 formed in a sliding member 120 which is located on the left hand side of FIG. 2. The sliding member 120 is appropriately slidably mounted in the lower housing 14. On the upper end of sliding member 120 is a wing 122 which is integrally formed with the remainder of sliding member 120 and which includes a rack of gears 124 on its undersurface. A gear segment 126 having an extension arm 128 integrally formed with it, is pivotally mounted about boss 130 which projects upwardly on the lower housing 14. The gear segment 126 engages the rack of gears 124. Movement of the crank disk 90 in response to rotation of spur gear 88 by pinion 66 causes the crank pin 92 to rotate and slide the sliding member 120 up and down as viewed in FIGS. 2 and 3. This in turn causes the gear rack 124 to also go up and down which in turn causes the gear segment 126 and its extension arm 128 to pivot about boss 130.

Spur gear 98 is always in engagement with long pinion 132. It will be remembered that spur gear 98 moves left and right in response to movement of the axle 86. In any case the spur gear 98 is in engagement with long pinion 132 concurrently with its engagement with pinion 64 as viewed in FIG. 3. Long pinion 132 is integrally formed with a bushing 134 and a spur gear 136. All of these are free to turn about axle 138 as a unit. Spur gear 136 has rounded teeth which allows it to maintain engagement with a pinion 140 which is formed as part of the attack means system 34. The point of interaction of spur gear 136 and pinion 140 is directly over the center of a boss 142. The significance of which will be pointed out in the next paragraph.

The attack means system 34 includes a bottom frame member 144 having a bearing 146 on one of its ends which is pivoted about boss 142. The other end of the frame 144 is free to slide on the surface of lower housing 14. Frame member 144 and thus the attack means system 34 pivots in an arcuate manner about boss 142 such that certain portions of the frame 144 and the endless belt 20 are swept in a reciprocal manner back and forth throughout the target field.

Mounted on one end of the frame 144 is upper spool 148 which serves as a first mounting means for endless belt 20 and mounted near the other end of frame 144 is lower spool 150 which serves as the other mounting point for endless belt 20. Spool 150 has a spur gear 152 integrally formed on one of its ends which engages with spur gear 154 which in turn is integrally formed as a unit with pinion 140. Both the upper and lower spools 148 and 150 are appropriately suspended on the frame 144 such that they are free to rotate. Rotation of pinion 132 via engagement of pinion 98 with pinion 64 as depicted in FIG. 3 is transferred via spur gear 136, pinion 140, spur gear 154 and finally spur gear 152 to lower spool 150 causing endless belt 20 to orbit about the spools 148 and 150. Because the point of interaction between spur gear 136 and pinion 140 is directly over the pivot point of the frame 144 the above described gear train is always complete no matter what position the frame 144 assumes with respect to its acute movement. This is evident from viewing FIGS. 2 and 3.

Projecting out of the side of the frame 144 is an arm 156 having a channel 158 therein. A downwardly extending boss 160 is formed on the bottom of arm 128. The boss 160 fits within the channel 158. Rotation of gear segment 126 and arm 128 are thus communciated to the arm 156 via interaction of the boss 160 with the channel 156. When the sliding member 108 is in the position shown in FIG. 2 the boss 160 is moved downwardly as per FIG. 2 causing the frame 144 to pivot counterclockwise to the position shown in FIG. 2. When the sliding member 108 is midway along its point of travel, i.e. the crank pin 92 is in line with the axle 86 as viewed in FIG. 3, the boss 160 has communicated this motion to the frame 144 placing the frame 144 in almost direct line with the longitudinal axis of the toy 10. Further clockwise rotation of the frame 144 caused by further extension of the sliding member 108 in an upwardly direction inclines the frame 144 toward the right such that it will be a mirror image of that shown in FIG. 2 when taken along an axis longitudinally dividing the toy 10. Rotation of the crank disk 90 and the crank pin 92 thus causes arcuate oscillations of the frame 144 back and forth. This is a first mode of movement causing the attack means system 34 and endless belt 20 forming a part thereof to reciprocate back and forth across the target field positioning the endless belt 20 first to the left of target 18*a*, then directly in line with target 18*a*, and then directly in line with target 18*b*, then directly in line with target 18*c* and then to the right of target 18*c* once again over target 18*c* and etc. through a never ending cycle. This first mode of movement will continue until the launch button 24 is depressed which disengages the connection between pinion 66 and spur gear 88 and connects the engagement between pinion 64 and spur gear 98. This then starts the second mode of movement that being movement of the endless belt 20 in an orbit around the spools 148 and 150.

Figure 5:
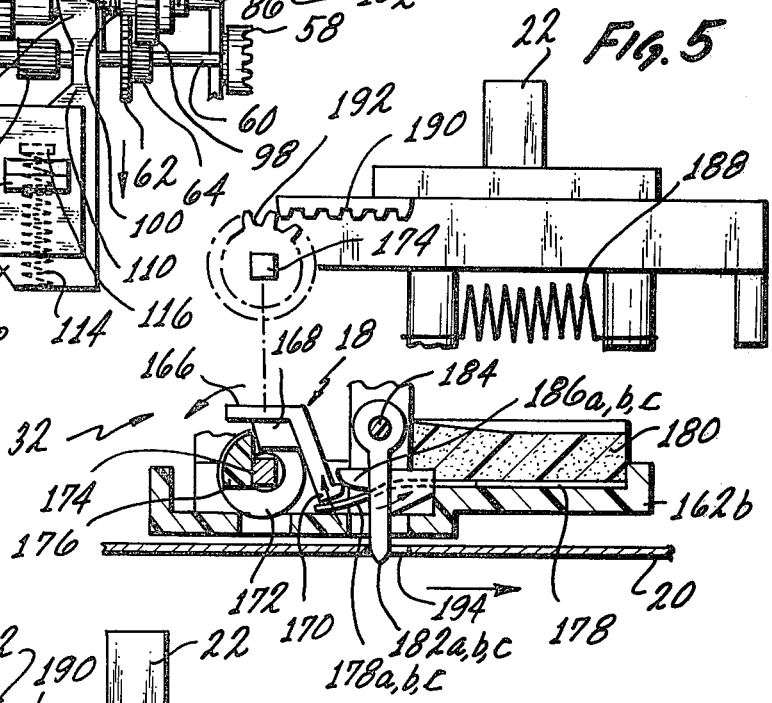
FIG. 5 is an exploded side elevational view in partial section about the line 5—5 of FIG. 2, the upper portion of the figure normally lies behind the lower portion but has been lifted for clarity and understanding.
Figure 6:
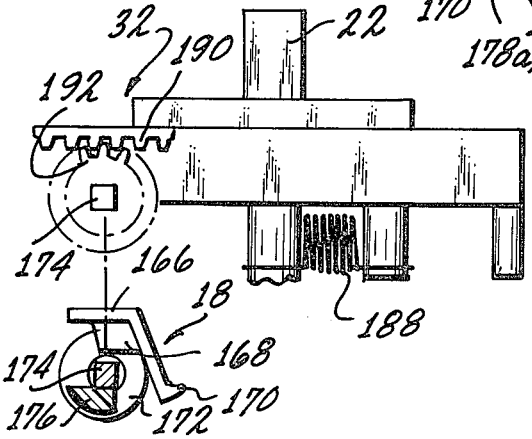
FIG. 6 is an exploded side elevational view in partial section showing certain portions of FIG. 5 with the components located in a different spacial relationship than as shown in FIG. 5.

The remaining system, the target system 32 is constructed as follows. A target housing 162 having an upper component 162*a* and a lower component 162*b* has a window 164 thereon wherein the targets 18*a, b* and *c* are located. The targets 18*a, b* and *c* are formed on one of the surfaces of trip members 166*a, b* and *c* as seen in FIGS. 4 through 6. These trip members seen in cross section in FIGS. 5 and 6 are composed of two flat plates (not separately numbered) set at an angle with each other and having brace members 168*a, b* and *c* joining them and dogs 170*a, b* and *c* located on their ends. The target itself is located on the horizontally oriented surface in FIGS. 5 and 6. The braces 168 attach to drums 172*a, b* and *c*. These drums are mounted about a square shaft 174. The drums are free to rotate independently of this shaft. Attaching to the drums, but held against one of the surfaces of the shaft, are cams 176*a, b* and *c*. The cams because they are held flush against the square shaft 174 rotate with it.

A flat spring 178 having arms 178*a, b* and *c* is held within the housing 162 by a piece of sponge 180. The sponge serves two purposes, the first being retention of the spring 178. Three trip levers 182*a, b* and *c* are mounted about axles 148*a, b* and *c* individually. The trip levers each carry a horizontally oriented arm 186*a, b* and *c*. The second function of the sponge 180 is to bias the trip levers 182*a, b* and *c* clockwise by interacting with the arm 186.

The target reset button 22 is biased by a spring 188 toward the positions shown in FIGS. 1 and 6. The reset button 22 carries a rack of gears 190 on it. This rack of gears interacts with a spur gear 192 fixedly mounted on square shaft 174. When the reset button 22 is moved from the position shown in FIG. 2 to the position shown in FIG. 5 the rack of gears 190 rotates the spur gear 192 and the square shaft 74 clockwise. As the square shaft 174 rotates clockwise it also rotates the cams 176*a, b* and *c* clockwise causing them to push against the braces 168 as shown in FIG. 5 to reset the trip members 176 to the positions shown in FIGS. 5 and 6. In rotating the square shaft 174 clockwise the spring 188 is tensed and when the button 122 is released it moves both the reset button 22 and the square shaft with its cam 176 located thereon back to the position shown in FIG. 6. When the target members 18 are reset the wedge shape of dog 174 depresses the arms 186 out of the way so that the dogs 170 can be located underneath them.

In the position shown in FIGS. 5 and 6 the dogs 170 abut against and depress the extensions of the flat spring 178*a, b* and *c*. The dogs 170 come to rest underneath the arms 186 of the trip levers 182. The trip levers 182 are biased to the position shown in FIG. 5 by the sponge 180. The dogs 170 are being pushed upwardly by the spring 178 but fixedly held in the position by the arms 186. If the trip levers 182 are moved counterclockwise and compressed into the sponge 180 the arms 186 clear the dogs 170 allowing the spring 178 to rotate the trip members 166 about the shaft 174. In doing so the targets 18 located on the surface of trip member 166 are flipped out of the view of the window 164 and the trip members 166 assume the position shown in FIG. 4.

The trip levers 182 are tripped as follows. Associated with the attack object 30 on the endless belt 20 is a rectangular cutout 194. Not seen in FIG. 2 is an identical set of attack object 30 and cutout 194 on the bottom of the endless belt. When the attack object 30 seen on the top of the endless belt in FIG. 2 is in a position to strike one of the targets 18 the cutout 194 on the bottom of the endless belt is positioned as seen in FIG. 5. If the cutout 194 is located directly beneath the trip lever 182 which controls one of the particular targets 18 the trip lever 182 will project through the cutout 194. As the endless belt 20 moves to the right in FIG. 5 the trip lever 182 is carried with it and is pivoted counterclockwise about its axle 184. This frees the arm 186 from the dog 170 causing the trip lever 182 to flip to the position shown in FIG. 4 removing the target 18 located thereon from view through the window 164. If the endless belt 20 is not correctly positioned directly below the trip lever 182 when the orbiting movement of the endless belt starts the trip lever 182 will not be tripped by the cutout 194. It can be seen that it is important that the endless belt be correctly positioned with respect to arcuate movement centered about the boss 142, about which the frame 144 pivots, if the trip lever 182 is to be tripped when orbiting movement of the endless belts 20 is initiated upon activation of the launch button 24. It requires a correct coordination of both the first mode of movement, the arcuate movement of the attack means system 34, positioning it in line with one of the targets 18*a, b* or *c* prior to transfer to the orbiting movement of the endless belt 20 by activation of the launch button 24. The attack means system 34 therefore has two modes of movement which must be considered if it is to trip one of the targets. Control of these modes of movement are challenging because they do not occur simultaneously. The first mode of movement of the attack means system 34 must be appropriately stopped at the correct position before the second mode of movement is started.

In describing the two modes of movement of the attack means system 34 it can be considered that the end of the frame 134 which is not mounted about boss 142, i.e. the end closest to the targets 18, moves through an arcuate motion centered about the boss 142. The other mode of movement can be considered to be normal or perpendicular to this mode of movement in that it is movement along the longitudinal axis of the frame 144. This movement along the longitudinal axis of the frame 144 would be perpendicular or normal to a tangent at the point of intersection between the longitudinal axis of the frame 144 and the arc formed by the arcuate movement of the end of frame 144.

I claim:

1. A toy game which comprises:

a housing;

at least one target member positioned within a target field on said housing;

an attack means movably located on said housing and capable of moving at any particular instance of time in one or the other but not simultaneously in both of two modes of movement with respect to the target field, one of the modes of movement sweeping in a reciprocal manner across the width of the target field, the other mode of movement moving at least a portion of the attack means in a direction of movement essentially normal to the direction of the first mode of movement, together said two modes of movement capable of positioning at least a portion of the attack means in an interacting position with said target member allowing said portion of said attack means to interact with said target member;

a drive means located on said housing;

a drive diverter means operatively associated with both said drive means and said attack means and interposed between said drive means and said attack means, said drive diverter means capable of propagating motion from said drive means to said attack means to move said attack means in one or the other but not simultaneously in both modes of movement.

2. The game of claim 1 wherein:

said portion of said attack means and said target member can be positioned in said interacting position through a combination of movement by movement in first one of said two modes of movement followed by movement in the other of said two modes of movement.

3. The game of claim 2 wherein:

said attack means includes an elongated frame means pivotally attaching to said housing near one of its ends such that the other end is capable of moving in an arcuate manner within said housing, a carrier means and an attack object located on said carrier means, said carrier means capable of moving between the two ends of said elongated frame means moving said attack object from one end of said frame means to the other end of said frame means;

said first mode of movement constituting arcuate movement of said frame means and said other mode of movement constituting movement of said attack object between the two ends of said frame means.

4. The game of claim 3 wherein:

said carrier means constitutes an endless belt and said frame means includes endless belt mounting means, said endless belt mounted on said endless belt mounting means for rotation on said frame means;

said attack object located on the surface of said endless belt for continued rotation of said attack object on said frame means.

5. The game of claim 4 including:

a plurality of target members positioned across the width of said target field;

said attack object capable of assuming an interacting position with each of said target members by a combination of movements of said attack object in both said first and said other modes of movement.

6. The game of claim 5 wherein:

said drive means constitutes a motor means located on said housing, said motor means capable of generating a rotary output motion;

said drive diverter means includes gear means and gear train selecting means, said gear means divided into at least a first and a second gear train, one of said first or said second gear trains operatively associated with said frame means and capable of reciprocally oscillating said frame means arcuately on said housing, the other of said first or said second gear trains operatively associated with said endless belt to rotate said endless belt about said endless belt mounting means;

said shifting means capable of engaging one or the other of said first or said second gear trains, but not simultaneously both of said gear trains with said motor means to cause rotation of one of said first or said second gear means with respect to rotation of said motor means.

7. The game of claim 6 wherein:

said drive diverter means includes a movable axle carrying at least two gears, one of the gears independent with respect to rotational movement of the other gear, one of the gears forming a portion of the first gear train and the other of the gears forming a portion of the second gear train, one of the gears engaging with and completing the first gear train when the axle is in the first position and the other of the gears completing and forming a portion of the other gear train when the axle is in the second position;

said shifting means including a shifting member operatively associated with said movable axle and capable of moving said axle between said first and said second positions.

8. The game of claim 7 wherein:

said gear train associated with said endless belt includes a first gear and a second gear, the plane of said second gear movable with respect to the plane of said first gear such that the plane of said second gear is capable of lying in the plane of said first gear in one instance and capable of pivoting about the intersection point of said first gear and said second gear both clockwise and counterclockwise in a second instance to position the plane of said second gear at an angle with the plane of the first gear, said angle centered at the point of intersection of the first and second gears.

9. The game of claim 8 wherein:

said housing includes an upstanding boss, said frame means includes a bearing means capable of fitting about said upstanding boss such that said frame is capable of pivoting about said boss;

said intersection point of said first gear and said second gear centered about the center of said upstanding boss.

10. The game of claim 5 wherein:

each of said target means includes a trip member pivotally mounted about an axle and capable of being located in a first position wherein said trip member exhibits a first surface and in a second position wherein said trip member exhibits a second surface;

trip means capable of retaining said trip member in a first position wherein said first surface is exhibited and causing said trip member to move to a second position wherein said second surface is exhibited;

reset means capable of moving said trip member from said second position to said first position.

11. The game of claim 10 including:

a plurality of target members positioned across the width of said target field;

said attack object capable of assuming an interacting position with each of said target members by a combination of movements of said attack object in both said first and said other modes of movement;

and wherein said drive means constitutes a motor means located on said housing, said motor means capable of generating a rotary output motion;

said drive diverter means includes gear means and gear train selecting means, said gear means divided into at least a first and a second gear train, one of said first or said second gear trains operatively associated with said frame means and capable of reciprocally oscillating said frame means arcuately on said housing, the other of said first or said second gear trains operatively associated with said endless belt to rotate said endless belt about said endless belt mounting means;

said shifting means capable of engaging one or the other of said first or said second gear trains, but not simultaneously both of said gear trains with said motor means to cause rotation of one of said first or said second gear means with respect to rotation of said motor means;

said drive diverter means includes a movable axle carrying at least two gears, one of the gears independent with respect to rotational movement of the other gear, one of the gears forming a portion of the first gear train and the other of the gears forming a portion of the second gear train, one of the gears engaging with and completing the first gear train when the axle is in the first position and the other of the gears completing and forming a portion of the other gear train when the axle is in the second position;

said shifting means including a shifting member operatively associated with said movable axle and capable of moving said axle between said first and said second positions;

said gear train associated with said endless belt includes a first gear and a second gear, the plane of said second gear movable with respect to the plane of said first gear such that the plane of said second gear is capable of lying in the plane of said first gear in one instance and capable of pivoting about the intersection point of said first gear and said second gear both clockwise and counterclockwise in a second instance to position the plane of said second gear at an angle with the plane of the first gear, said angle centered at the point of intersection of the first and second gears;

said housing includes an upstanding boss, said frame means includes a bearing means capable of fitting about said upstanding boss such that said frame is capable of pivoting about said boss;

said intersection point of said first gear and said second gear centered about the center of said upstanding boss.

* * * * *